United States Patent [19]

Oory et al.

[11] 4,278,190

[45] Jul. 14, 1981

[54] CONCRETE DISCHARGE HOPPER

[75] Inventors: Robert F. Oory, Hampshire; Charles J. Arndt, Elk Grove, both of Ill.

[73] Assignee: Rotec Industries, Inc., Elmhurst, Ill.

[21] Appl. No.: 109,929

[22] Filed: Jan. 7, 1980

[51] Int. Cl.[3] ..... B65G 41/00

[52] U.S. Cl. ..... 222/561; 198/311

[58] Field of Search ..... 198/534, 532, 530, 546, 198/311; 222/559, 561, 545; 251/326; 414/519, 520; 105/282 R, 280, 287, 288, 289

[56] References Cited

U.S. PATENT DOCUMENTS

| | | | |
|---|---|---|---|
| 1,501,793 | 7/1924 | Maxon | 222/561 |
| 2,896,770 | 2/1957 | Ross et al. | 198/311 |
| 3,083,879 | 4/1963 | Coleman | 222/561 |
| 3,814,294 | 6/1974 | Stevenson | 222/561 |

*Primary Examiner*—Robert B. Reeves
*Assistant Examiner*—Brian Bond
*Attorney, Agent, or Firm*—Allegretti, Newitt, Witcoff & McAndrews, Ltd.

[57] ABSTRACT

A very large hopper capable of discharging concrete of varying consistency onto a moving belt conveyor in a smooth continuous ribbon. The hopper will handle concrete which is predominately mortar, up to concrete having aggregate comprising 4 to 6 inch mean diameter rocks. In a preferred embodiment the hopper has a flat inclined wall containing a discharge opening closed by a sliding primary gate with a "W" shaped leading edge; the primary gate also having a discharge opening closed by a sliding secondary gate.

12 Claims, 7 Drawing Figures

Fig. 5
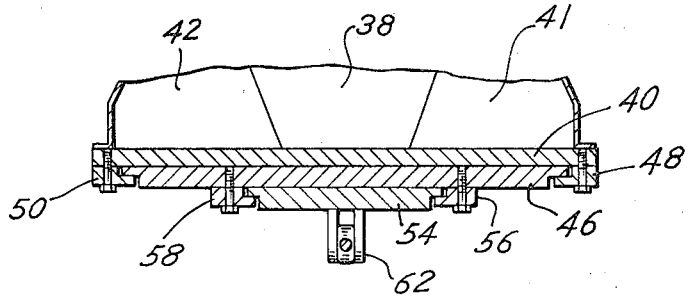
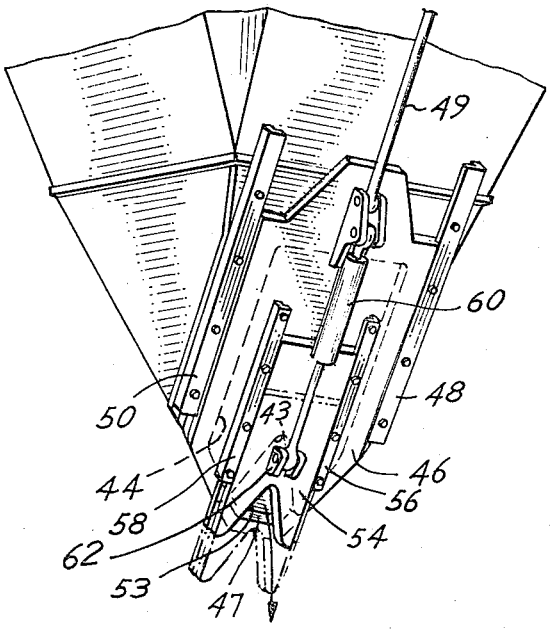
Fig. 6
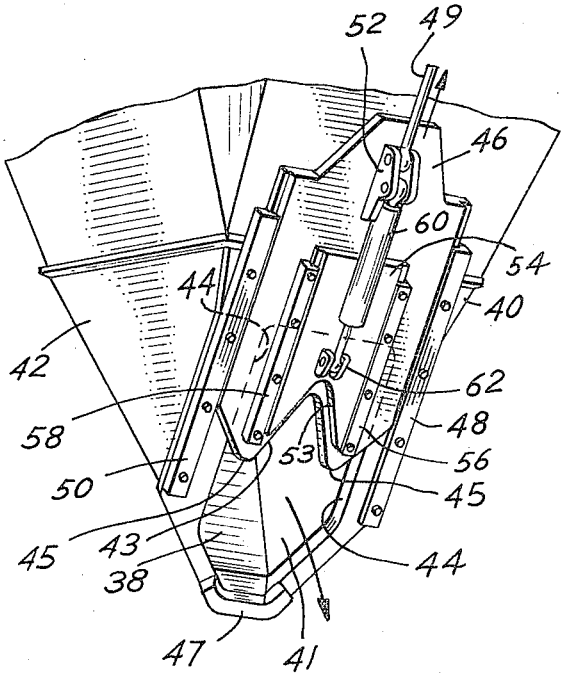
Fig. 7

CONCRETE DISCHARGE HOPPER

BACKGROUND OF THE INVENTION

This invention relates to conveyor means for placing concrete and more particularly to a hopper construction from which concrete is discharged onto the belt of the conveyor for carrying concrete to the point of deposition.

Concrete varies in consistency depending upon the relative proportions of water-cement and aggregate solids which, in turn, affect the flow characteristics of the mix. The flow is also affected by the size range of the aggregate which occupies 60 to 80 percent of concrete volume. The consistency or workability of the mix may vary from that of a free flowing slurry to a composition which is fairly stiff and resistant to flow. In conveying concrete it is essential that the aggregate be distributed uniformly throughout the mass and that the coarse aggregate does not separate from the sand-cement mortar. For maximum cured strength the cement binder must cure in contact with all of the aggregate.

It is the primary object of this invention to provide a large capacity hopper, say in the range of 8 to 10 cubic yards volume, which is capable of discharging concrete of widely varying consistency in a smooth continuous ribbon onto the surface of a moving belt which accurately places the concrete.

A further object is to provide a discharge hopper of this kind which is capable of handling concrete containing very coarse aggregate including stones up to 4 to 6 inch mean diameter. Another object is to provide a hopper of this kind which discharges the concrete at a rate of 7 to 10 cubic yards per minute without overloading the belt, or causing the concrete to strike the belt with such force that it bounces off the belt and falls to the ground, or is separated from the cement mortar.

It has been proposed heretofore to provide a conical-shaped hopper having a horizontal discharge opening in the bottom which is closed by a sliding door that moves across the opening. This construction permits regulating the volume of concrete which is discharged from the hopper but it is not capable of accurately controlling the direction of the concrete flow. When the sliding door is fully opened the concrete is discharged directly downwardly with great speed and force so that it strikes the moving belt, bounces off the belt and separates the aggregate. If the door is closed to the point where the concrete flows onto the belt at a controlled uniform rate in a continuous ribbon without any undesirable splashing or separation, the capacity of the conveyor is drastically reduced. Furthermore, when the concrete contains large-sized aggregate, such as six-inch stones, they will not pass through the partially-closed opening but instead become lodged between the side wall of the opening and the edge of the door. This further restricts the flow and may even block the opening.

It has also been proposed to provide a clam shell closure pivotally mounted for closing and opening a horizontally disposed opening at the bottom of the hopper. In such a structure when the hinged shells are opened the concrete flows directly down to the belt as described previously in connection with the single closure door construction. The head of concrete in a hopper of the kind herein disclosed may exceed 15 feet. The concrete weighs 135 to 160 lbs. per cubic foot. The force of gravity acting on this extremely heavy mass causes the concrete, and particularly the aggregate therein, to strike the conveyor belt with great force. Unless the flow is carefully controlled the conveyor belt and its supporting structure can be severely damaged by the concrete. Also the aggregate separates from the mortar portion of the mix.

To reduce the force with which the concrete strikes the belt it has been proposed to close the horizontal opening in the bottom of the hopper with a single clam shell which pivots downwardly, about a horizontal axis, away from the opening and serves as sort of a slide for the concrete when in open position. This structure protected the belt from the force of the concrete but was not satisfactory because of its tendency to trap aggregate while closing, thus remaining partially open.

The disadvantages of these prior art structures are overcome and the objectives of the invention are accomplished by providing a hopper having inclined side walls forming the bottom thereof and providing a discharge opening through one of said side walls, which is flat. The side wall opposite the opening serves as a chute or slide and places the moving concrete passing through the opening onto the moving belt in the direction of movement in a continuous ribbon.

BRIEF DESCRIPTION OF THE DRAWING

In accordance with a preferred embodiment of the present invention the hopper at its lower end is of rectangular or polygonal cross section having side walls that are flat and generally triangular in shape. The discharge opening in the flat side wall is closed by a primary sliding gate, itself having an opening therethrough, which in turn is closed by a smaller secondary gate. A preferred embodiment of the invention is shown in the accompanying drawings in which

FIG. 5 is a sectional view taken along the 5,5 of FIG. 4;

FIG. 6 is a perspective view of the lower end of the hopper and discharge opening with the secondary gate partially opened and shown in closed position in broken lines; and FIG. 7 is a view like that of FIG. 6 in which the primary gate is in fully opened position.

DETAILED DESCRIPTION OF THE PREFERRED EMBODIMENT

Figure 1:
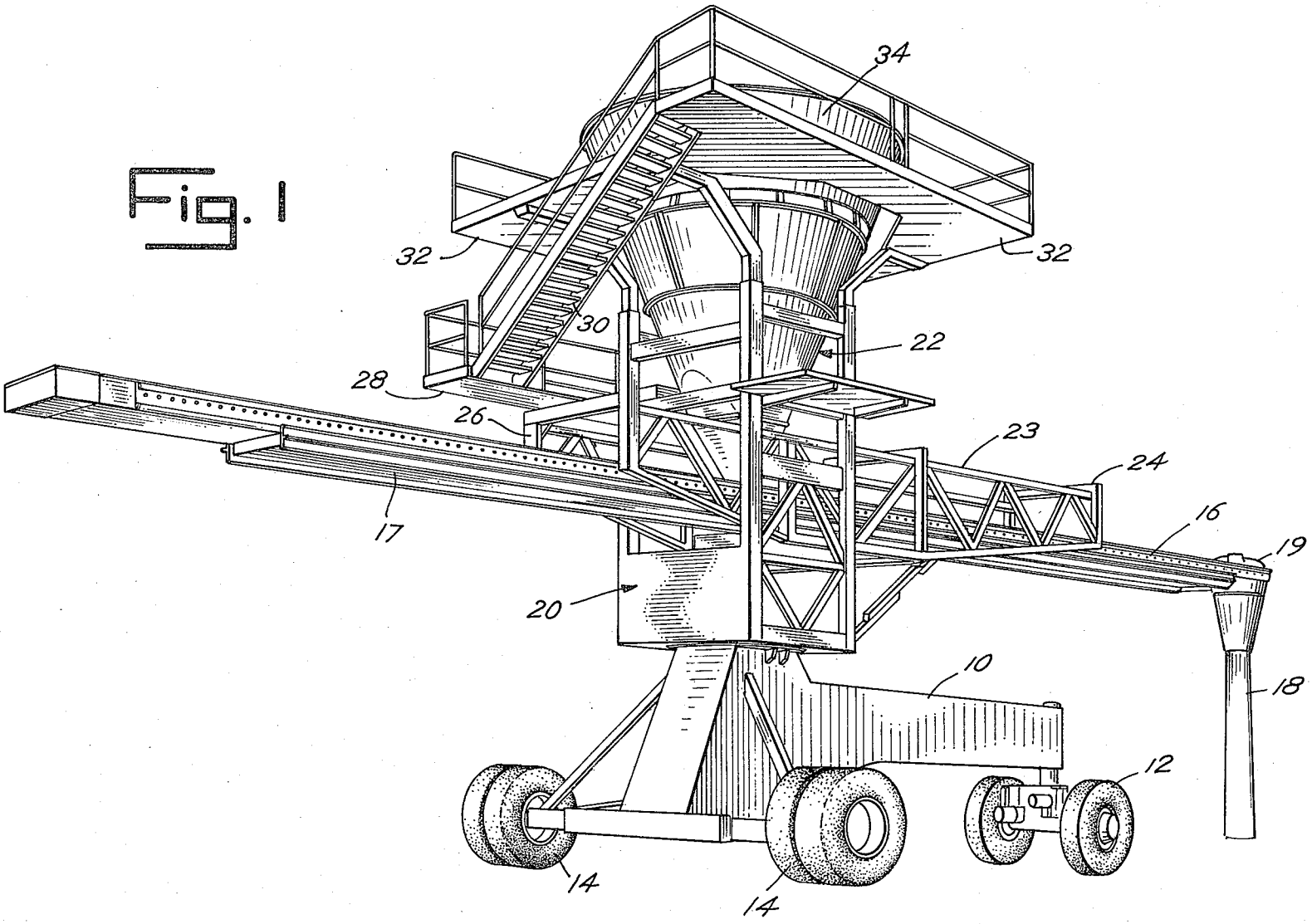
FIG. 1 is a perspective view of a concrete placing apparatus comprising the hopper/conveyor combination of our invention.

Referring to FIG. 1 the concrete placing conveyor of the invention is mounted on a large truck having a frame 10 and front and rear wheels 12 and 14. The front wheels 12 swivel and are driven by electric motors to move the entire conveyor apparatus mounted on the truck. Other conventional means of support are also available, e.g. spider base, pogo stick or "QUAD-POD." A frame member 20 fabricated from steel beams and firmly fixed to the frame 10 supports the hopper 22 and the conveyor 16. A truss member 23 extends outwardly from the main frame 20 and carries rollers (not shown) at the lower ends of the terminal yoke members 24, 26 on which the conveyor frame 16 is slidably mounted. A motor driven conveyor belt 15 is mounted on rollers on the frame 16 and at the discharge end of the belt a hood 19 directs the concrete into an elephant's trunk 18 for placing the concrete precisely in the desired location. A pan 17 may be secured to the frame 16 beneath the belt. A scraper (not shown) is provided beneath the frame to remove any concrete adhering to the surface of the belt.

A platform 28 is provided for the operator of the apparatus, the platform being supported by the main frame 20. A second platform 32 is provided near the top of and surrounding the hopper 22 and is accessible from platform 28 via the stairway 30. The upper portion of the hopper 22 comprises a frusto-conical funnel 34 which in the particular form of the invention illustrated is about 15 feet in diameter.

In operation the concrete to be placed is discharged into the hopper 22 from a large bucket carried by a crane. The concrete flows from the bottom of the hopper 22 through the structure described below onto the moving belt and downwardly through the elephant's trunk 18 to the point of deposition. The frame of the conveyor belt may be moved outwardly or retracted to adjust the reach of the belt. The frame 16 slides on rollers secured to the lower ends of the yokes 24, 26. In the fully extended position the conveyor has a reach of about 80 feet. The variable length of the conveyor coupled with the swivel wheels 12 which permit lateral adjustment of the elephant's trunk, provide a great deal of latitude in depositing concrete.

Figure 3:
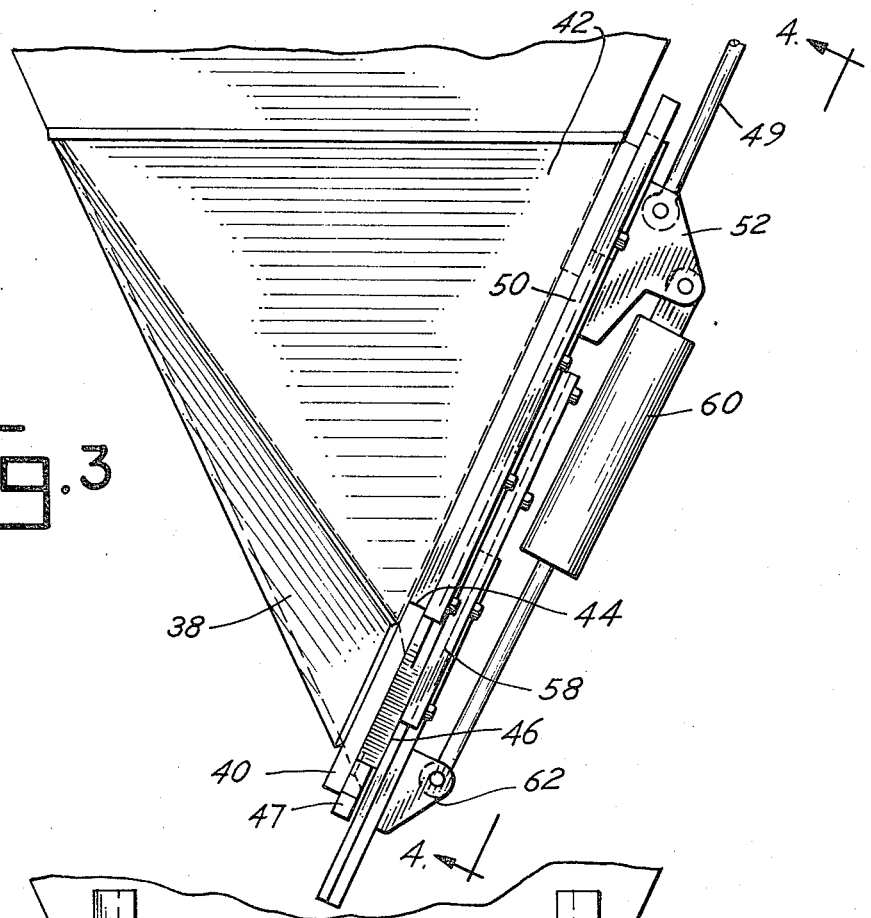
FIG. 3 is an enlarged side elevational view of the discharge opening and associated parts included within the circle 3 of FIG. 2.
Figure 4:
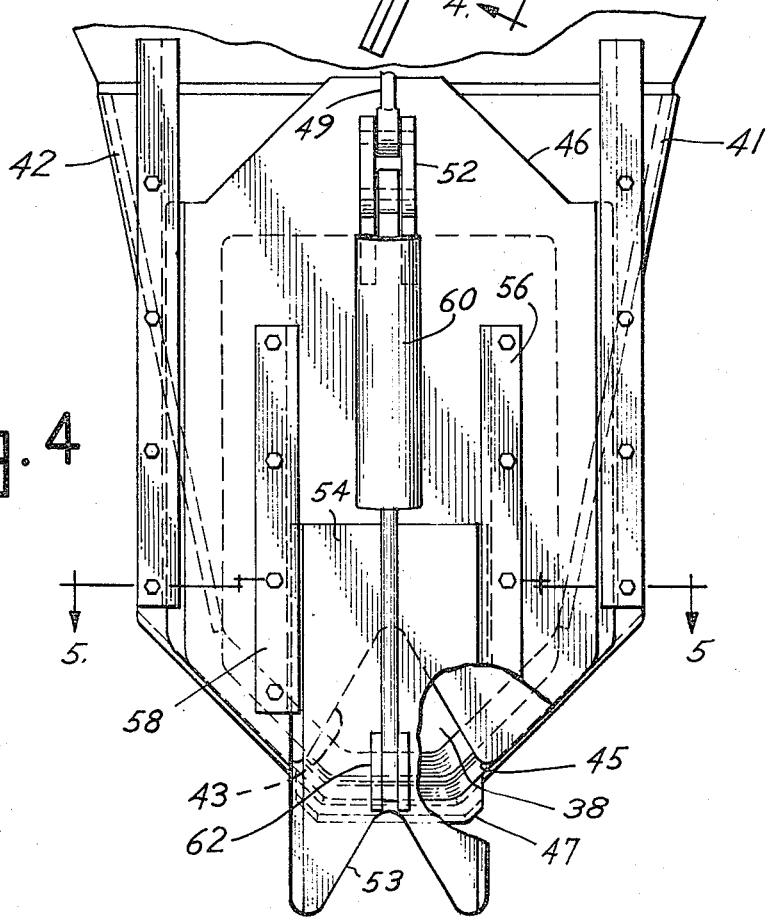
FIG. 4 is a front view of the discharge openings and closure gates therefor taken along the line 4,4 of FIG. 3.

Referring to FIG. 3 it will be noted that the very bottom of the hopper comprises flat converging side walls of generally triangular shape. Side wall panels 41 and 42 run longitudinally of the conveyor belt 15 while side wall panels 38 and 40 run across the length of the belt. In order to carry the gates, side wall 40 is made from heavier metal than the other panels comprising the bottom of the hopper. The concrete discharge opening 44, cut in the wall 40, terminates at its lower end in a V-shaped configuration which follows the contour of the wall 40. Wall 40 is the only hopper wall that must be flat since it contains the discharge opening and carries the closure gates.

Figure 2:
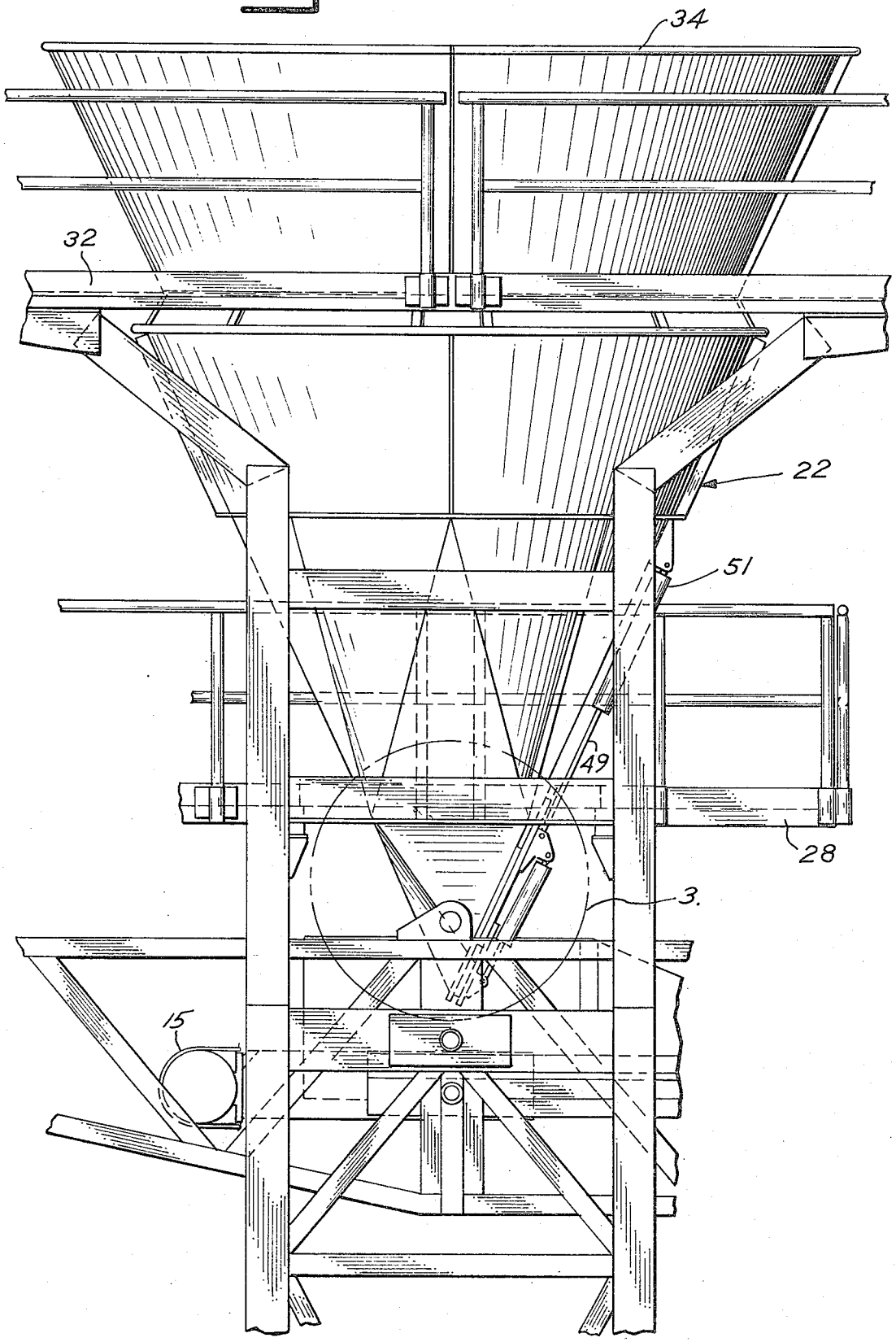
FIG. 2 is a side elevational view of the hopper itself.

A primary gate 46 slidably mounted in ways 48, 50 serves to slide over the opening 44 to cut off the flow of concrete. The gate 46 is actuated by an hydraulic cylinder 51 (or other suitable linear actuator) having a piston rod 49 pivotally connected to the bracket 52 attached to the front face of the primary gate 46, as shown in FIGS. 2 and 7. The lower end of the gate 46 is shaped like a "W" with a pair of peaks 45 and V-shaped depression 43 between the peaks. The W-shaped gate passes through the aggregate as it moves downwardly into closed position, pushing the stones, or shearing the stones, and seating on the stop or bumper 47 welded to the side wall 40 at the bottom. In the closed position the inverted "V" 43 provides a discharge opening of relatively small area through which fluid concrete may be discharged onto the moving belt below the hopper.

To close off the opening 43 we have provided a secondary gate 54 which slides in ways 56, 58 mounted on the outer surface of the primary gate 46. Gate 54 is mounted above the bumper 47 and can slide past it. The secondary gate 54 is actuated by an hydraulic cylinder 60 which connects between a bracket 52 and the bracket 62, the latter being welded to the face of the secondary gate 54. The lower end of the gate 54 has a notch 53 which permits variable communication with the interior of the hopper through the opening 44 near the bottom thereof. The opening 44 can be completely closed when the gate 54 is lowered to the position shown in broken lines in FIG. 6. The purpose of this opening is to effect a small controllable opening for small aggregate, high slump concrete or even mortar (sand, cement and water). In this mode of operation, gate 46 remains closed, gate 54 is raised as required. Notch 53 serves the same purpose as the "W" of gate 46—to displace stones, or shear them off, and allow complete closure.

The angle of the side walls 38 and 40 is about 75 degrees from the horizontal and may range between 50 and 80 degrees. It will be noted that the inclination of the wall 38 is in the direction of the forward movement of the belt 15 which carries the concrete forward to the elephant trunk 18. The inner surface of the wall 38 serves as a slide to feed the concrete through the opening 44 and onto the surface of the belt in a continuous ribbon. Because of the inclination, the concrete flows readily through the opening even when the consistency is stiff.

In operation the secondary door is opened first to permit an initial flow of concrete through the V-shaped opening 43 in the primary door. To increase the volume of concrete discharged the primary gate 46 is lifted to the desired height by actuating the cylinder 51.

The V- or W-shaped contour of the gate 46 and the similar contour of gate 54 provided by notch 53 is an important feature of the invention. If the configuration of the bottom of the gate is straight across we have found that aggregate, especially large stones, will become jammed beneath the gate when it is closed. The peaks 45 work their way through the aggregate or shear stones if they become trapped and cause the stones to move outwardly so that the gate can close against the bumper 47. The precise shape of the gate terminus will be determined to some extent by the shape of the opening it is adapted to close. It is important however that the contour be in the form of an inclined plane or pointed projection that will force the rock aggregate out of the plane of the opening to permit closing the gate.

The operator of the apparatus stands on the platform 26 on which conventional controls are mounted to close and open the gates on the hopper, to telescopically move the conveyor in and out and to rotate the entire apparatus by actuating the motor driven wheels 12.

What is claimed is:

1. A hopper for controlling a flow of concrete to a moving belt comprising:

(a) a plurality of inclined side walls converging toward the bottom of said hopper;

(b) one of said side walls being flat and having a concrete discharge opening therethrough;

(c) primary gate means, slidably mounted on said one of said side walls and capable of moving across said concrete discharge opening, for shearing said flow of concrete, said primary gate means terminating at its lower end in an inverted substantially V-shaped opening;

(d) means for actuating said primary gate means and causing said primary gate means to progressively close said concrete discharge opening; and (e) stop means connected with said hopper for arresting downward movement of said primary gate means;

(f) a secondary gate mounted on said primary gate means for closing said inverted substantially V-shaped opening.

2. The hopper of claim 1 in which the side wall opposite said one side wall is inclined in the direction of belt movement.

3. The hopper of claim 2 in which said wall opposite said one side wall is inclined at an angle of between 50° and 80° to the horizontal.

4. The hopper of claim 1 in which said actuating means comprises a linear actuator.

5. The hopper of claim 1 in which said primary gate means slides in ways mounted at the sides of said concrete discharge opening.

6. Claim 1 which includes a movable belt beneath said hopper, the side wall opposite the discharge opening providing a slide inclined in the direction the belt moves in conveying the concrete.

7. Claim 6 in which the angle of inclination of said slide is between 50° and 80°.

8. A hopper for controlling flow of concrete to a moving belt comprising:

(a) a plurality of inclined side walls converging toward the bottom of the hopper, (b) one of said side walls being inclined at an angle greater than 50° to the horizontal and having a concrete discharge opening therethrough, (c) a primary gate slidably mounted on the outside of said one side wall for movement across said discharge opening, (d) a linear actuator connected to the top of said primary gate to progressively close said discharge opening, (e) said primary gate terminating at its lower end in a pair of pointed projections spaced to provide a gap therebetween, (f) stop means on said hopper against which said projections abut, thereby arresting downward movement of said primary gate while said gap is in communication with the interior of the hopper, (g) a secondary gate slidably mounted on the outer face of said primary gate for closing said gap, and (h) means for actuating said secondary gate.

9. The hopper of claim 8 which includes a movable belt beneath said hopper, the side wall opposite the concrete discharge opening providing a slide inclined in the direction the belt moves in conveying the concrete.

10. The hopper of claim 9 in which the angle of inclination of said slide is between 50° and 80°.

11. A hopper for controlling a flow of concrete to a moving belt comprising:

(a) a plurality of inclined side walls converging toward the bottom of said hopper;

(b) one of said side walls being flat and having a concrete discharge opening therethrough;

(c) a primary gate slidably mounted on said one of said side walls for movement across said concrete discharge opening, said primary gate terminating at its lower end with two substantially V-shaped projections and an inverted substantially V-shaped opening therebetween;

(d) a secondary gate slidably mounted on said primary gate for closing said inverted substantially V-shaped opening; and (e) means for actuating said primary gate and said secondary gate.

12. The hopper of claim 11 in which the bottom thereof is spaced above the belt a distance approximately equal to, but not less than, the maximum height of said inverted V opening.

* * * * *

UNITED STATES PATENT AND TRADEMARK OFFICE

CERTIFICATE OF CORRECTION

PATENT NO. : 4,278,190

DATED : July 14, 1981

INVENTOR(S) : Robert F. Oury and Charles J. Arndt

It is certified that error appears in the above—identified patent and that said Letters Patent is hereby corrected as shown below:

Inventors: "Robert F. Oory", should be --Robert F. Oury--.

Signed and Sealed this

*Sixth* Day of *October 1981*

[SEAL]

*Attest:*

GERALD J. MOSSINGHOFF

*Attesting Officer*

*Commissioner of Patents and Trademarks*